US007938662B2

(12) United States Patent
Burris et al.

(10) Patent No.: US 7,938,662 B2
(45) Date of Patent: May 10, 2011

(54) SEALS AND METHODS FOR SEALING COAXIAL CABLE CONNECTORS AND TERMINALS

(75) Inventors: Donald Andrew Burris, Peoria, AZ (US); Kenneth Steven Wood, Elmira, NY (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 12/157,566

(22) Filed: Jun. 11, 2008

(65) Prior Publication Data

US 2008/0311789 A1 Dec. 18, 2008

Related U.S. Application Data

(60) Provisional application No. 60/934,876, filed on Jun. 15, 2007.

(51) Int. Cl.
*H01R 13/52* (2006.01)

(52) U.S. Cl. ..... 439/272

(58) Field of Classification Search ..... 439/271–272, 439/578

See application file for complete search history.

(56) References Cited

U.S. PATENT DOCUMENTS

| | | | | |
|---|---|---|---|---|
| 4,674,818 | A | 6/1987 | McMills et al. | 439/275 |
| 4,869,679 | A | 9/1989 | Szegda | 439/272 |
| 6,007,378 | A * | 12/1999 | Oeth | 439/588 |
| D504,113 | S | 4/2005 | Montena | D13/154 |
| 7,097,500 | B2 | 8/2006 | Montena | 439/587 |
| 7,182,621 | B2 * | 2/2007 | Reichle | 439/352 |
| 7,186,127 | B2 | 3/2007 | Montena | 439/277 |
| 7,311,555 | B1 | 12/2007 | Burris et al. | 439/594 |
| 7,632,141 | B2 * | 12/2009 | Malak | 439/578 |
| 2005/0029807 | A1 | 2/2005 | Montena | 285/151.1 |

FOREIGN PATENT DOCUMENTS

EP 1693930 A2 8/2006

OTHER PUBLICATIONS

U.S. Appl. No. 11/637,556, filed Dec. 12, 2006, "Compression Seal for Coaxial Cable Connector and Terminal".

* cited by examiner

*Primary Examiner* — Truc T Nguyen

(74) *Attorney, Agent, or Firm* — Joseph M. Homa; Matthew J. Mason

(57) ABSTRACT

Methods of connecting a coaxial connector and a terminal include providing a coaxial connector with a coupler, the coupler having a seal member in contacting relationship with the coupler such that the seal member is coaxial with the coupler about a longitudinal axis, affixing the coupler to the terminal and after the coupler is affixed to the terminal, sliding the seal member longitudinally toward, and into contact with, the terminal. When in a tightening position, the seal member covers an engagement surface of the coupler, and wherein when in a deployed position, the seal member contacts at least a portion of the terminal.

8 Claims, 11 Drawing Sheets

SEALS AND METHODS FOR SEALING COAXIAL CABLE CONNECTORS AND TERMINALS

CROSS-REFERENCE TO RELATED APPLICATIONS

This application claims the benefit of, and priority to U.S. Provisional Application No. 60/934,876, filed Jun. 15, 2007, the content of which is relied upon and incorporated herein by reference in its entirety.

BACKGROUND OF THE INVENTION

1. Field of the Invention

The present invention relates to seal members for coaxial cable connectors, and particularly to seal members for sealing junctions between coaxial cable connectors and terminals.

2. Technical Background

Coaxial cable connectors such as Type F connectors are used to attach a coaxial cable to another object such as an appliance having a terminal adapted to engage the connector. Such connectors must be attached to a coaxial cable using various cable preparation techniques and installation tools. Cable preparation typically requires removal of a portion of the cable jacket, braid, outer conductor and core to expose the cable center conductor. Another portion of the cable jacket is removed to expose the cable braid and cable preparation is completed by folding of the cable braid structure back against the remaining cable jacket. The cable is then inserted into the connector, after which the connector is secured to the coaxial cable. For outdoor applications the connector is generally sealed to the cable either by the internal workings of the connector or by the use of an external sealant, heat shrinkable tubing, rubber cement, fusing tape or rubberized boot.

In order to help maintain the integrity of the coaxial system, moisture should be prevented from entering the terminal/connector/cable junction. In the past, attempts have been made to provide seals by using a rubber type material in the form of a tight fitting ring with an inner bore and an outer diameter or shape. For various reasons, the foregoing attempts have yielded less than satisfactory results. For example, attempts at encapsulating the connectors with tapes, shrink wrappings and plastic or rubber cements are too prone to installation errors, which can result in exposed seams and/or internal voids where moisture can collect and eventually penetrate to the cable junction. Moreover, shrink wrappings require the use of heat or chemicals which further complicate installation procedures. Cements require time to set up and cure, thus prolonging and complicating installation procedures. The use of sealing components such as externally applied flexible boots and/or grommets can result in internal voids where moisture can collect. In addition, installation of tight fitting seal rings is difficult and therefore many times is avoided. Subsequent removal of tight fitting seal rings after a lengthy period of service can be even more difficult than installation.

Additionally, existing seal rings are limited in use by the length of the terminal port on which they are installed. A specific length seal ring must be matched with and installed on a terminal port of compatible length thereby requiring the technician to: a) recognize various port lengths, and b) have a correct assortment of seal rings on hand.

One example of a known seal ring is illustrated in FIG. 1 (Prior Art). A connector 50 is illustrated, as attached to cable 30, and includes a coupler 60. Terminal 10 comprises external threads 12 for mating with connector 50. Seal ring 70 is illustrated as attached to the terminal 10 and has an internal bore 72 that is smaller in diameter than the threaded section 12 and/or smooth section 14 of terminal 10. Weather sealing between seal ring 70 and terminal 10 is accomplished by a press-fit between seal ring inner bore 72 and terminal smooth section 14 and/or threaded section 12.

However, issues arise with this arrangement in that such seal rings cover substantially most of the threads on the appliance port and require that at least a portion of the corresponding cable connector coupler engage the seal ring while engaging the port threads. This engagement during tightening can cause difficulty in turning the connector coupler, thus making the connector hard to install.

SUMMARY OF THE INVENTION

A seal member is disclosed herein for forming a seal at the juncture of a coaxial cable connector and a terminal, wherein the coaxial cable connector is secured to an end of a coaxial cable. The seal member can be advantageously mounted on the connector to form a seal member/connector assembly, or seal-connector assembly. The connector of the seal-connector assembly can be secured to the coaxial cable prior to connection of the seal-connector assembly with the terminal. The seal member can be slid over the connector and into contact with the terminal while maintaining contact with the connector. Preferably, the entire seal member is slid over, i.e. translates over, the connector and into contact with the terminal. The seal member can thus provide a 360° environmental seal around the connector-terminal junction. In some embodiments, the seal member is slidably mounted on a coupler, such as a nut, of the connector. The seal member is generally tubular with an inner surface having a first inner diameter, located at least at a first axial position on the seal member, which is smaller than an outer diameter of the terminal, and the inner surface having a second inner diameter, located at least at a second axial position on the seal member, which is smaller than an outer diameter of the terminal, wherein the first and second diameters may be equal or different, and wherein the first and second axial positions may be equal or different. In the deployed position, the inner surface of the seal member contacts the connector and forms a 360° seal thereat, and the inner surface of the seal member contacts the terminal and forms a 360° seal thereat. In some embodiments, the seal member has a uniform tubular wall thickness. In other embodiments, the seal member has a variable thickness wall; in some of these embodiments, the seal member has a first portion having a first wall thickness which is larger (i.e. thicker) than the wall thickness of another portion of the seal member, and preferably the first portion is disposed at or proximate a front end of the seal member, wherein "front" is the direction in which the seal member would face toward the terminal and "back" is the direction in which the seal member would face toward the coaxial cable, wherein such first portion can be advantageously provided to reduce the force required to slide the seal member over the coaxial connector. In accordance with one embodiment of the present invention, a method of connecting a coaxial connector and a terminal includes providing a coaxial connector comprising a coupler, the coupler having a seal member in contacting relationship with the coupler such that the seal member is coaxial with the coupler about a longitudinal axis, affixing the coupler to the terminal and after the coupler is affixed to the terminal, sliding the seal member longitudinally toward, and into contact with, the terminal.

In accordance with another embodiment of the present invention, a method of connecting a coaxial connector and a terminal including providing a coaxial connector comprising a coupler, the coupler having a seal member in surrounding relationship with the coupler, mating the coupler to the terminal and forming a seal between the coaxial connector and the terminal by sliding the seal member from a tightening position wherein the seal member covers at least a portion of the coupler to a deployed position wherein the seal member contacts at least a portion of the terminal.

In accordance with yet another embodiment of the present invention, a seal assembly for sealing a coaxial connector to a terminal includes a seal member having a first annular face and a second annular face with a bore between the first and second annular faces for contacting a coaxial connector coupler of the connector, wherein when in a tightening position, the seal member covers an engagement surface of the coupler, and wherein when in a deployed position, the seal member contacts at least a portion of the terminal.

It is to be understood that both the foregoing summary and the following detailed description of the present embodiments of the invention are intended to provide an overview or framework for understanding the nature and character of the invention as it is claimed. The accompanying drawings are included to provide a further understanding of the invention, and are incorporated into and constitute a part of this specification. The drawings illustrate various embodiments of the invention, and together with the description serve to explain the principles and operations of the invention.

DETAILED DESCRIPTION

Figure 1:
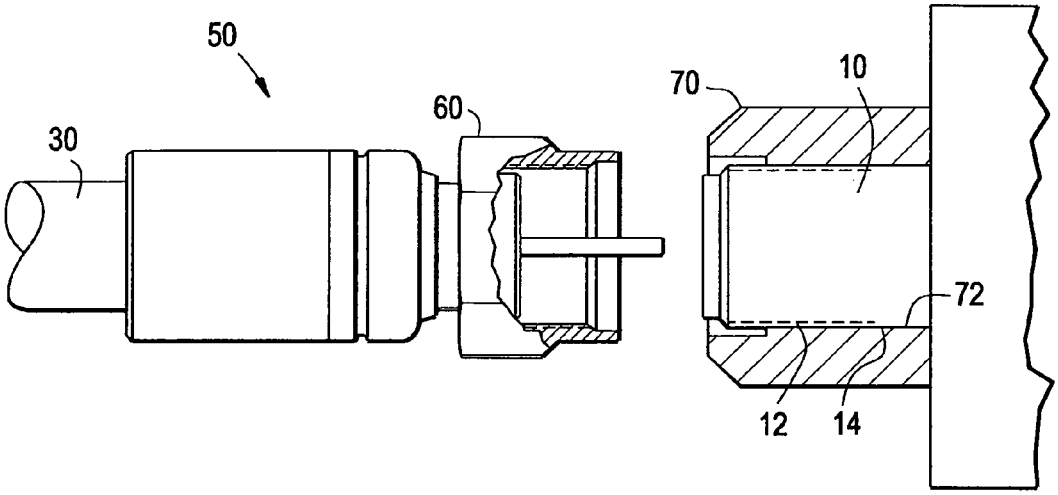
FIG. 1 PRIOR ART
FIG. 1 is a cross sectional illustration of a prior art seal ring installed on a terminal with a coaxial cable connector (shown in partial cross section) positioned to be connected to the terminal.

Reference will now be made in detail to the embodiment(s) of the invention, examples of which are illustrated in the accompanying drawings. Whenever possible, the same reference numerals will be used throughout the drawings to refer to the same or like parts.

Figure 2:
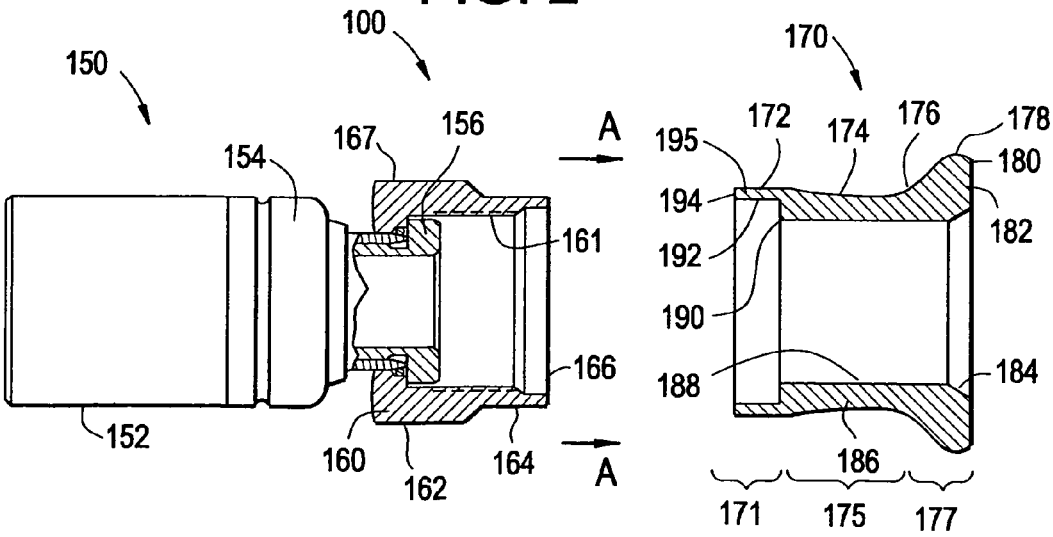
FIG. 2 is a partial cross sectional exploded view of an exemplary coaxial cable connector and a cross sectional view of an exemplary seal member in accordance with one embodiment of the present invention.

Referring to FIG. 2, an exemplary embodiment of a seal assembly 100 comprising a coaxial cable connector 150 and seal member 170 of the present invention is illustrated in an exploded form. As described more fully herein, seal members of the present invention can be used to seal a junction between a connector and a terminal in applications such as television cables/terminals. As illustrated in FIG. 2, an exemplary connector 150 (for attachment to the coaxial cable 130 of FIG. 2A) includes a fastening member 152, a body 154, a post 156 and a coupler 160. Coupler 160 can include threads 161 for mating with a terminal, an external surface 162, a sealing surface 164 and an inner bore 166. At least a portion of the external surface 162 comprises an engagement surface 167 for receiving a wrench or other tightening tool, as discussed later herein. In the embodiment illustrated in the drawings, the coupler is a nut, however, it should be understood that coupler may comprise any device configured to secure a connector to a terminal. Accordingly, any number of connectors having a variety of couplers can be utilized with the present invention.

As also illustrated in FIG. 2, an exemplary embodiment of a seal member 170 may comprise a first portion 171 having first outer diameter 172. One or more optional transition portions 174 and 176 may be located intermediate to the first portion 171 and a second portion 177 (e.g., intermediate portion 175 comprises transition portions 174 and 176). Second portion 177 may include a second outer diameter 178, an optional outer chamfered area 180, a first annular face 182 and an optional inner chamfer area 184. Seal member 170 may also include variable thickness wall segment 186 along transition portions 174 and 176. A bore 188 may be located between the first annular face 182 of second portion 177 and a second annular face 194 of first portion 171. In addition, a counter bore 192 may be located within wall segment 196 of first portion 171. In one embodiment, seal member 170 can be molded from a rubber-like material such as ethylene propylene diene monomer rubber (EPDM), vinyl or the like, and can be treated to resist the effects of ultraviolet light on plastics and plastic related materials.

Figure 3:
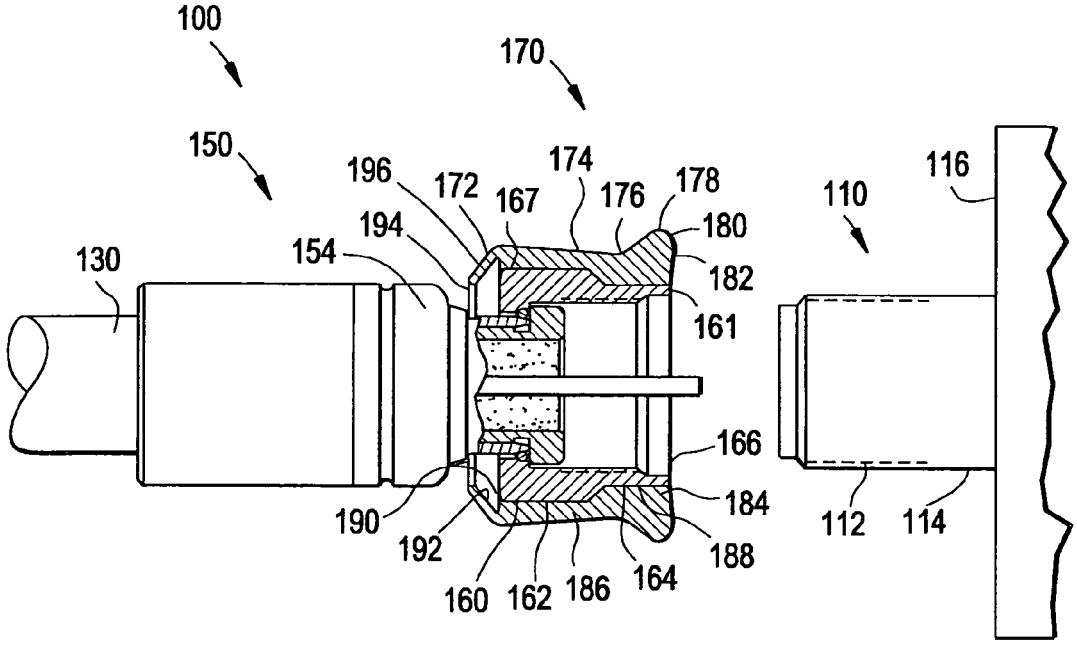
FIG. 3 is a partial cross sectional view of an exemplary assembled coaxial cable connector/seal member positioned to be connected with a terminal in accordance with one embodiment of the present invention.
Figure 4:
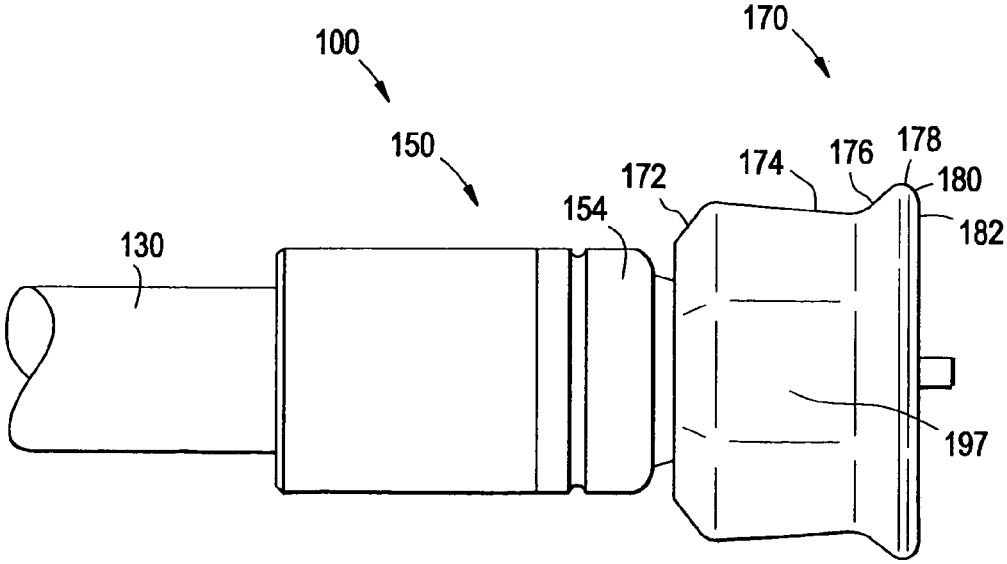
FIG. 4 is a side view of the coaxial cable connector/seal member assembly of FIG. 3 and in a tightening position in accordance with one embodiment of the present invention.

Referring to FIGS. 2-4, it is contemplated that in some embodiments, a seal member 170 is installed onto coupler 160 of connector 150 prior to securing the connector to a terminal 110 or to a cable 130. Seal member 170 is installed over coupler 160 by inserting coupler 160 into bore 188 of seal member 170 and moving coupler 160 along the axial A direction parallel to the longitudinal axis of the connector 150 (e.g., see FIG. 2), so that coupler 160 and seal member 170 are in a surrounding, contacting coaxial relationship. As illustrated in FIG. 3 (and FIGS. 10, 12 and 15-18, discussed later herein), it is contemplated that in some embodiments the seal assembly, having the seal member 170 installed over connector, is assembled prior to securing connector to a terminal (or in some embodiments, prior to securing the connector to the cable), such as at a factory/warehouse, or by the technician in the field.

As illustrated throughout the drawings, the elastomeric properties of seal member 170 permit seal member 170 to stretch and conform to the external surfaces of coupler 160 of connector 150. Particularly, the inner surface of the wall segment 196 and variable thickness wall segment 186 (or intermediate portion 175) of seal member 170 substantially adapts or conforms to the external surface 162 and sealing surface 164 of coupler 160 (e.g., the coupler and seal member are geometrically similar). In addition, in embodiments such as those shown in FIGS. 3-4, 11-12 and 15-18, stretching and forming of the seal member 170 about the external surface of the coupler 160 preferably causes the wall segment 196 of first portion 171 of seal member 170 to bias inward toward body 154 of connector 150. FIG. 4 illustrates a full side view of the seal member 170 installed onto coupler 160 (not shown), as well as the shape conforming relationship between the sealing member and underlying coupler. Particularly, as illustrated in FIG. 4, circumferential surface 197 of seal member may comprise a general hexagonal shape which is in a conforming relationship to the underlying hexagonal coupler 160. However, it should be understood that circumferential surface 197 may comprise any number of shapes and/or configurations so as to conform to the shape and/or configuration of the underlying coupler.

Figure 2A:
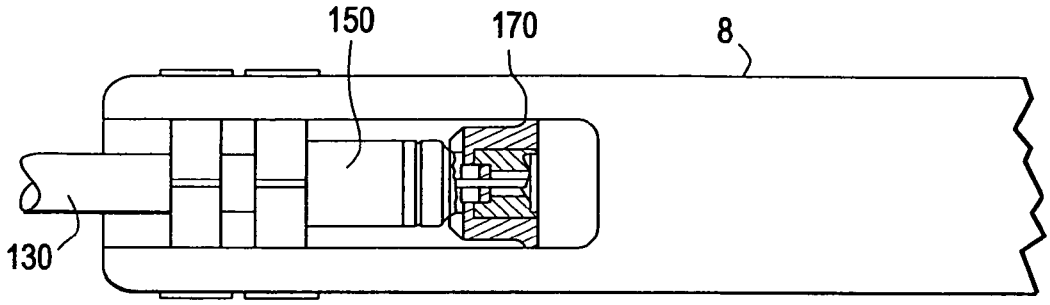
FIGS. 2A and 2B are partial top and side views, respectively of a conventional compression tool utilized to secure a cable to a connector in accordance with one embodiment of the present invention.
Figure 2B:
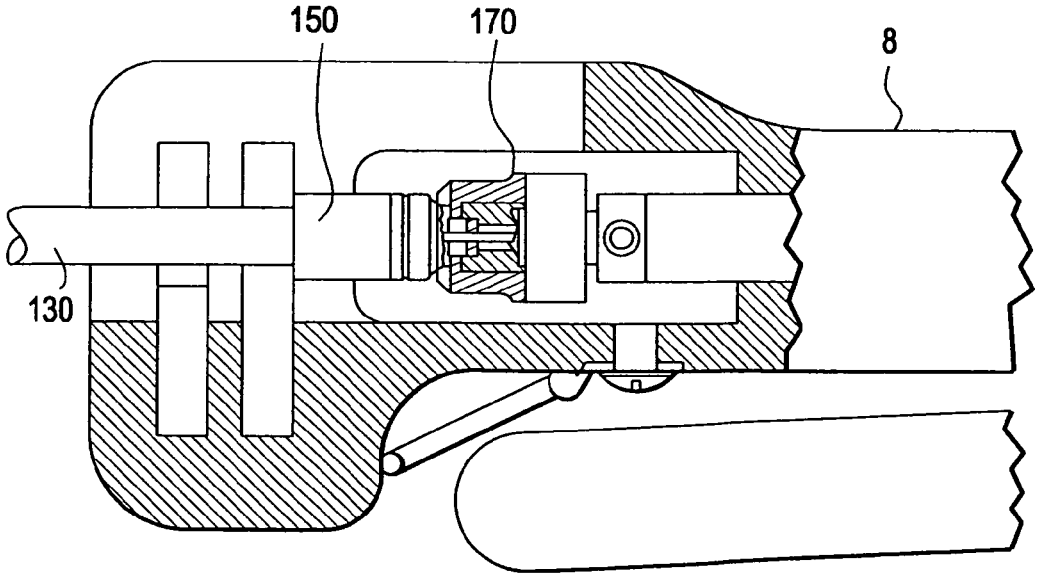
Figure 5:
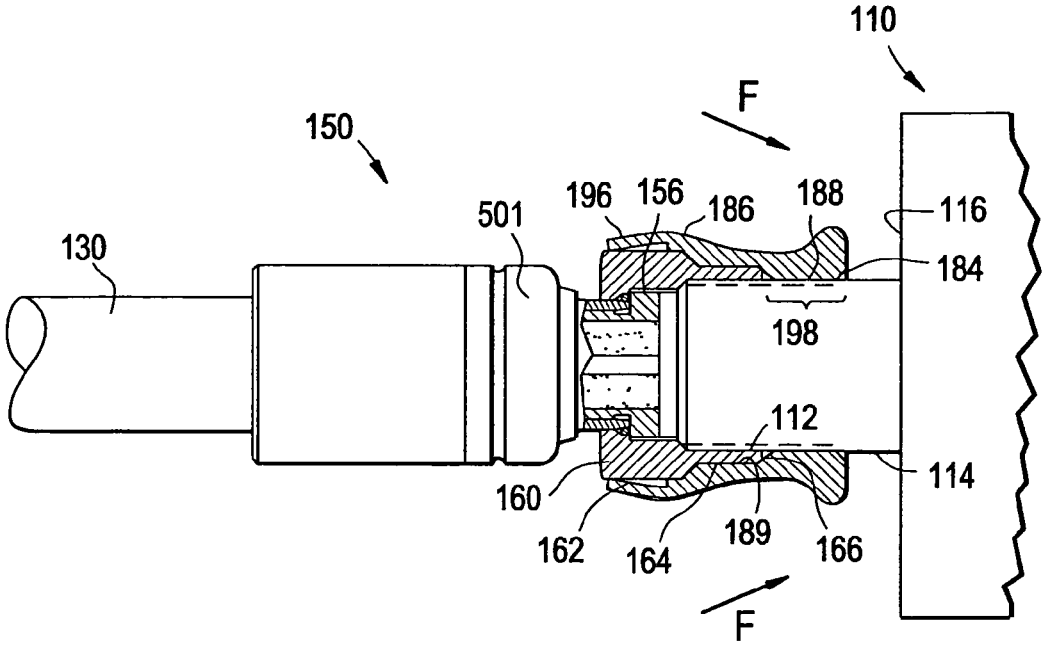
FIG. 5 is a partial cross sectional view of the coaxial cable connector/seal member assembly of FIGS. 3 and 4 joined with a terminal and in a deployed position in accordance with one embodiment of the present invention.

As illustrated in FIGS. 2A and 2B, one aspect of the present invention is that the connector 150 with some embodiments of the seal member 170 can be secured to a cable 130 with a conventional compression tool 8 without interference from seal member 170. Referring to FIGS. 3-5, connector 150, with seal member 170 installed over coupler 160, has been joined with cable 130 and is ready to be connected to terminal 110 (e.g., FIG. 5 illustrates this connection). Terminal 110 may comprise a threaded section 112, a smooth section 114 and/or surface 116. Surface 116 may include a back plate, a neck and/or a junction with another connector (e.g., a splicer arrangement). In addition, as used herein, "terminal" may include any one of or all components of a standard terminal such as that described herein. Moreover, those skilled in the art will appreciate that the externally threaded section of the terminal may vary in dimension (diameter and length) and configuration (e.g., a "short" terminal or a "long" terminal, as contrasted in FIGS. 6 and 7).

Connector 150 may be secured to terminal 110 by aligning threads of coupler 160 with threaded section 112 of terminal 110 and rotating coupler 160 (through contact by the seal member 170) about terminal 110. Particularly, once the coupler 160 and terminal 110 are in mating engagement, a technician may grip the seal member 170 (which is in contact with the coupler 160 as described above) and tighten coupler about the terminal 110. In such an arrangement, and as illustrated in FIGS. 3 and 4, the seal member 170 can be said to be in a tightening position (e.g., wherein the seal member substantially covers the coupler 160). Because the seal member 170 conforms to the shape of the associated coupler 160 and because of the friction therebetween, rotation of the seal member 170 with respect to the coupler 160 is substantially prevented or reduced, particularly when gripped by the technician. Thus, wall segment 186 (e.g., intermediate portion 175) of seal member 170, being in general frictional contact with external surface 162 of coupler 160, facilitates rotation of coupler 160 by turning the seal member 170.

To facilitate connection of the connector to the terminal 110, coupler 160 is affixed and hand tightened to terminal. Because of the frictional fit between the seal member and connector, and due to the increased torque afforded by the increase in diameter due to the pressure of the seal member (compared to no seal member), the coupler 160 can be hand tightened beyond a location attainable by hand tightening through direct contact with the coupler 160 alone.

Another aspect of the present invention is that the seal member 170, while generally stationary with respect to the coupler 160 during rotation of the coupler 160 and seal member 170 (e.g., the seal member 170 will not generally rotate with respect to the coupler 160), the seal member 170 is axially moveable (longitudinally moveable along an axis) with respect to the coupler 160 so that the seal member can seal a junction between the connector and the terminal. Thus, a seal between the coupler 160 and the terminal 110 is created and the outer surface of the coupler 160 is exposed for further tightening. For example, referring to FIG. 5, once coupler 160 is secured to terminal 110, seal member 170 may be slid or moved axially (i.e., along a longitudinal axis) toward terminal (or surface 116) with the application of an applied force represented generally by arrows labeled "F." In this embodiment, the inner surface 189 of seal member that forms bore 188 contacts and conforms to the exterior surfaces of coupler 160 as well as the terminal 110 when the seal member contacts the terminal. Chamfered area 184 tracks the transition of seal member 170 from the coupler 160 onto threaded section 112 of terminal 110 as the seal member moves from a tightening position to a deployed position. Particularly, transformation of seal member 170 from the tightening position (e.g., wherein the seal member covers, or substantially covers, the coupler 160) to deployed position (e.g., wherein the seal member contacts the terminal 110) is accomplished by pressure applied in a direction toward terminal 110 as indicated generally by arrows in the F direction.

It is contemplated that seal member 170 can form a seal with terminal at any portion of the terminal 110. For example, referring to FIG. 5, seal member forms a seal 198 on the threaded portion of terminal 110. In such an embodiment, wall segment 196 and variable thickness wall segment 186 are in contact with external surface 162 of coupler 160. In addition, wall segment 186 is in contact with the sealing surface 164 of coupler 160. For sealing a threaded portion of a terminal, seal member 170 is preferably made of a relatively soft material to aid in allowing a portion of the seal member to at least partially enter the grooves provided on the threaded portion of the terminal.

Figure 6:
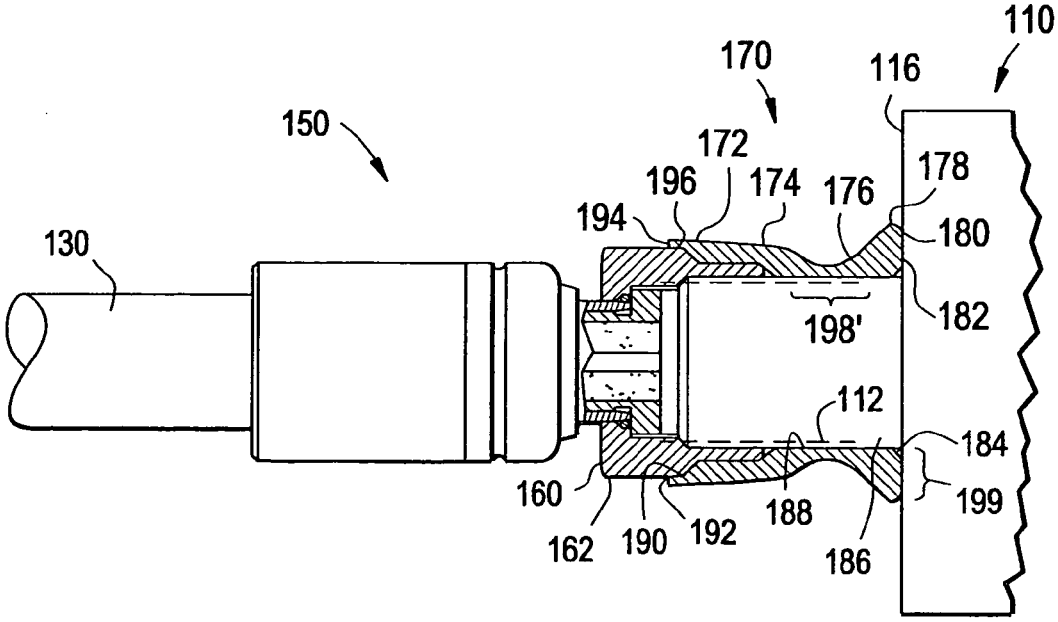
FIG. 6 is a partial cross sectional view of the coaxial cable connector/seal member assembly of FIGS. 3-5 joined with a terminal and in a deployed/exposure position in accordance with one embodiment of the present invention.

Referring to the embodiment in FIG. 6, the seal member 170 may be further slid axially over the coupler 160 and terminal 110 and toward wall 116 to form a seal 199 with a surface 160 of terminal 110. In such embodiment, annular face 182 forms seal 199 with surface 160, and the inner surface of seal member forming the bore 188 forms a seal 198' with the threaded and smooth portions (e.g., 112 and 114, respectively) of the terminal 110. As illustrated, variable thickness wall segment 186 is not in contact with external surface 162 of coupler 160, but is in contact with both the sealing surface 164 of coupler 160 and the terminal 110. In some embodiments, seal member 170 is dimensioned such that its length would permit variable thickness wall segment 186 to contact external surface 162 of coupler 160, even when annular face 182 forms a seal 199 with surface 160.

Being relatively flexible, the wall segment 186 (e.g., intermediate portion 175) of seal ring 170 permits variation in axial positioning, as illustrated in FIG. 6. Particularly, wall segment 186 allows the portion defining counter bore 192 to push up over and conform about external surface 162 of coupler 160. Additionally, frictional load applied between the portion defining the bore 188 and the coupler sealing surface 164 increase resistance to rotation of the seal member relative to the coupler as discussed above, serving to further secure coupler 160.

Figure 7:
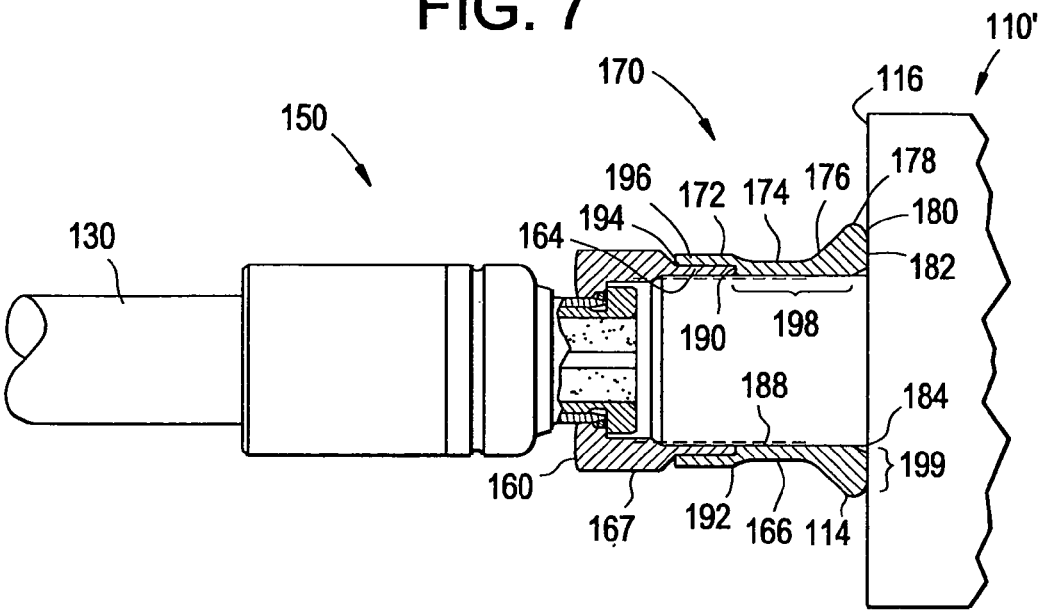
FIG. 7 is a partial cross sectional view of the coaxial cable connector/seal member assembly of FIGS. 3-4 joined with an alternative terminal and in a deployed/exposure position in accordance with one embodiment of the present invention.

In addition, as illustrated in FIG. 7, embodiments of seal member 170 can also be used with "long" port terminals 110' to form a seal between the coupler 170 and the terminal 110'. In such embodiments, sealing surface 164 of coupler 160 fits within counter bore 192 between wall segments 196. In this regard, it should be understood that the seal members in accordance with embodiments of the present invention can be used with a number of terminals and terminal features (e.g., a terminal having an optional shoulder), and that the invention should not be limited to the examples discussed herein.

Figure 8:
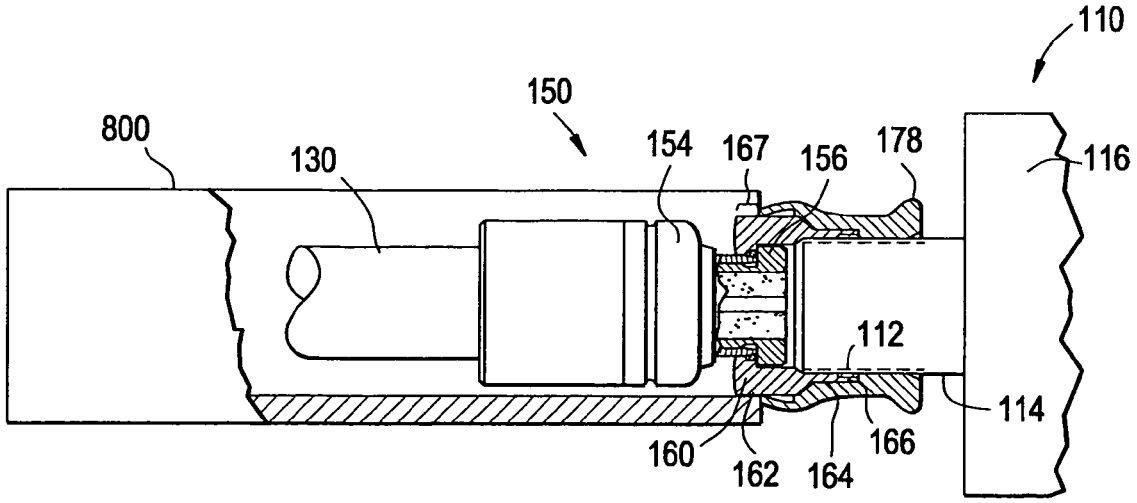
FIG. 8 is a partial cross sectional view of an exemplary coaxial cable connector/seal member assembly joined with a terminal in a deployed/exposure position and engaged with a tool at the exterior surface of the coupler in accordance with one embodiment of the present invention.

As discussed above, the ability of the seal member to move axially about the coupler under an applied axial force such as by hand provides benefits such as creation of a seal between the coupler 160 and the terminal 110, as well as exposure of an engagement surface of the coupler 160 for further tightening. With respect to the latter, and referring to FIGS. 3-8, seal members of the present invention are axially moveable from a tightening position (e.g., FIGS. 3 and 4) for hand tightening the coupler 160 through contact with the seal member 170, to an exposure position (e.g., FIGS. 6-8) via 800 (FIG. 8) so that a wrench can contact an engagement surface 167 to further secure the coupler 160 to the terminal 110 (110' in FIG. 7). Particularly, to move the seal member into the exposure position, the seal member 170 is slid axially along the coupler 160 (such as with tool 800) to expose the engagement surface 167 of the external surface 162 of the coupler 160. Once the engagement surface 167 is substantially exposed (e.g., effectively exposed so that a wrench or other standard tightening apparatus can grip the coupler), a conventional wrench standard in the industry can directly contact the coupler 160 and be used to further tighten the coupler 160. Similarly, conventional security sleeves can be used with seal members of the present invention. Accordingly, embodiments of the coaxial cable connector/seal member assemblies of the present invention can be easily installed, provide a clearer view of mating threads during installation, can be used with conventional tooling such as compression tools or wrenches, and/or can improve finger gripping for driving the coupler.

Figure 9:
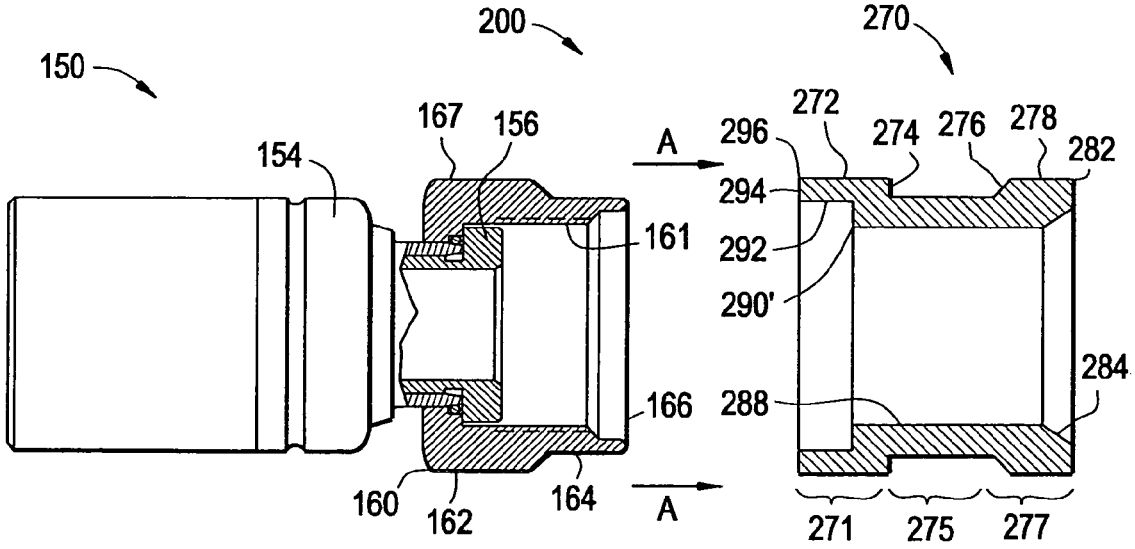
FIG. 9 is a partial cross sectional exploded view of an exemplary coaxial cable connector and a cross sectional view of an alternative seal member in accordance with one embodiment of the present invention.

As discussed herein, embodiments of the present invention include coaxial connectors having seal members which are axially moveable with respect to the connectors. In this regard, it will be understood that a number of arrangements of seal members can be utilized within the scope of the invention. For example, referring to FIGS. 9-11, an alternative embodiment of a seal assembly 200 with a seal member 270 of the present invention is illustrated in an exploded form. Referring to FIG. 9, the connector of FIG. 2 is illustrated (for attachment to the cable 130 of FIG. 10) and includes a fastening member 152, a body 154, a post 156 and a coupler 160. Coupler 160 can include threads 161, an external surface 162, a sealing surface 164, an inner bore 166 and an engagement surface 167.

The alternative embodiment of the seal member 270 comprises a first portion 271 having first outer diameter 272. Transition portions 274 and 276 are located intermediate to the first portion 271 and a second portion 277 (e.g., intermediate portion 275). In one embodiment, transition portion 276 may comprise an angle of approximately 45°. Second portion 277 may include a second outer diameter 278, a first annular face 282 and an inner chamfer area 284. Moreover, whereas the first and second outer diameters in other embodiments (e.g., 172 and 178, respectively, of FIGS. 2-8) are not the same, the first and second diameters (e.g., 272 and 278, respectively) of FIGS. 9-11 are substantially equal in this embodiment.

By varying the diameter (and the shape) of the seal member along its length, performance relating to the conforming may be enhanced. For example, in the embodiment of FIGS. 9-11, the spacing between the first portion 271 and the second portion 277 (e.g., the dimensions of the intermediate portion 275) may facilitate bending about the coupler. Particularly, intermediate portion 275, being generally longer and thinner than intermediate portion 175 of FIG. 2 may result better axial movement about coupler 160.

Still referring to FIG. 9, seal member 270 may also include variable thickness wall segment 286 between transition portions 274 and 276. A bore 288 may be located between the first annular face 282 and a second annular face 294. In addition, a counter bore 292 may be located within wall segment 296 of first portion 271. In the embodiment illustrated in FIGS. 9-11, wall segment 296 comprises one or more torsion support portions 301 annularly dispersed about wall segment 296 (see FIG. 11). As discussed later herein, torsion support portions 301 can further assist a technician in grasping the seal member in both tightening the coupler 160 and in axially moving the seal member over the coupler 160.

Figure 10:
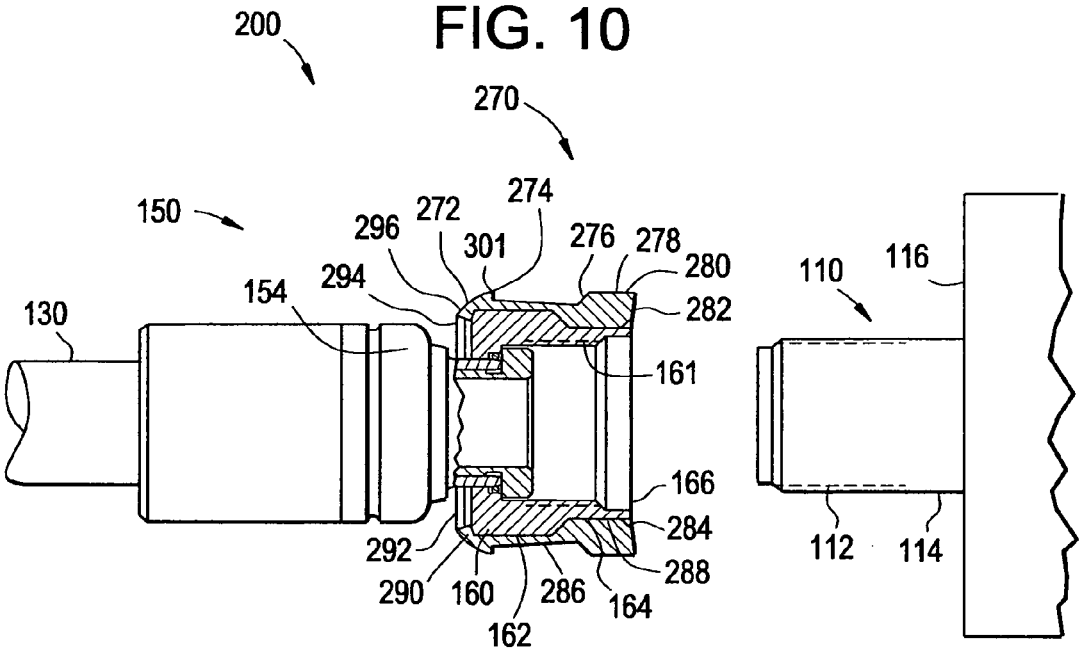
FIG. 10 is a partial cross sectional view of the assembled coaxial cable connector/seal member assembly of FIG. 9 positioned to be connected with a terminal in accordance with one embodiment of the present invention.
Figure 11:
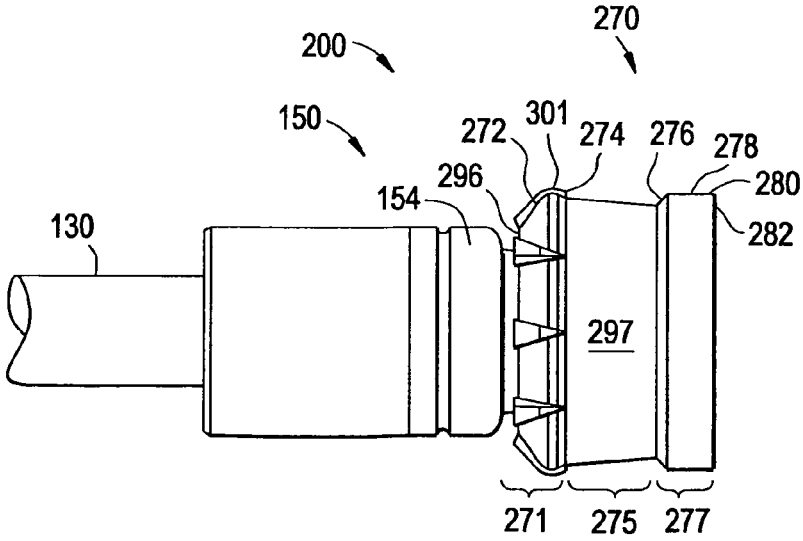
FIG. 11 is a side view of the coaxial cable connector/seal member assembly of FIG. 10 in accordance with one embodiment of the present invention.

Referring to FIGS. 10-11, seal member 270 is illustrated as installed onto coupler 160 of connector 150, prior to securing the connector to a terminal 110. Seal member 270 is installed onto coupler 160 by inserting coupler 160 into bore 288 of seal member 270 and moving coupler 160 along the A direction (e.g., see FIG. 9). Similar to the embodiment illustrated in FIGS. 2-8, the elastomeric properties of seal member 270 permit seal member 270 to stretch and conform to the external surfaces of coupler 160 of connector 150. Stretching of the seal member 270 about the external surface of the coupler 160 causes the wall segment 296 and associated torsion support portions 301 of first portion 271 of seal member 270 to bias inward toward head 254 of connector 150. FIG. 11 illustrates a full side view of the seal member 270 installed onto coupler 160. As illustrated, circumferential surface 297 of seal member may comprise a general hexagonal shape conforming to the underlying coupler 160.

Figure 12:
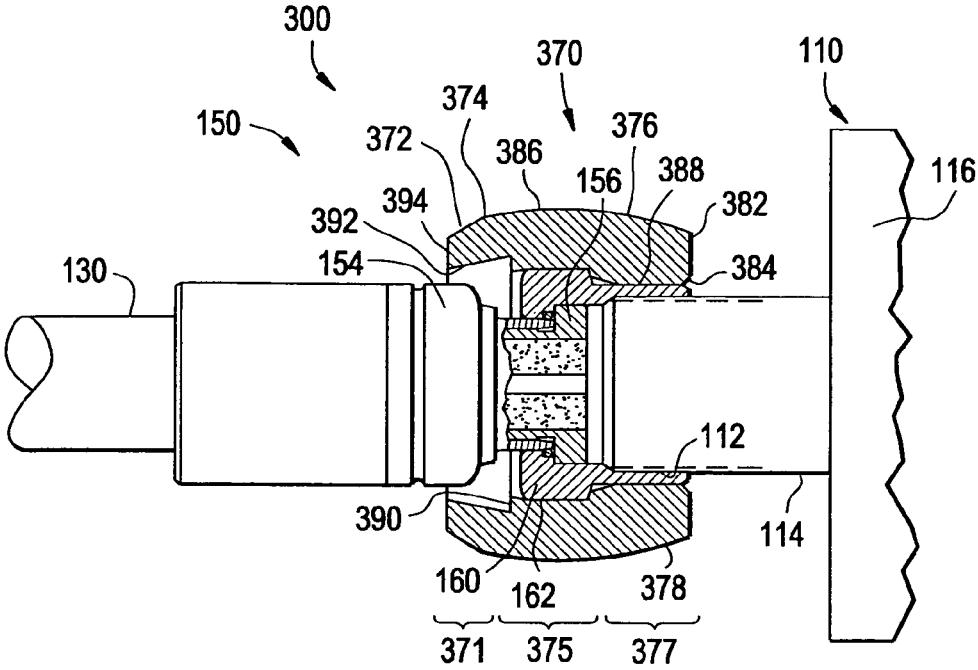
FIG. 12 is a partial cross sectional view of an alternative coaxial cable connector/seal member assembly joined with a terminal and in a tightening position in accordance with one embodiment of the present invention.

As illustrated in FIG. 10, connector 150 with seal member 270 installed over coupler 160 is ready to be installed to terminal 110. Similar to the embodiment described in FIGS. 2-8, connector 150 may be secured to terminal by aligning threads of coupler 160 with threaded section of terminal and rotating coupler 160 about terminal. Particularly, once the coupler 160 and terminal are in mating engagement, a technician may grip the seal member 270 (which is in contact with the coupler 160) and tighten coupler about the terminal. In such an arrangement, and as illustrated in FIGS. 11 and 12, the seal member 270 can be said to be in a tightening position (e.g., wherein the seal member substantially covers the coupler 160). Because the seal member 270 conforms to the shape of the associated coupler 160, rotation of the seal member 270 with respect to the coupler 160 is substantially prevented. Thus, wall segment 286 of seal member being in general rigid contact with external surface 162 of coupler 160 results permits rotation of coupler 160 by turning the seal member 270. Coupler 160 is hand tightened to terminal.

As previously discussed, and referring to FIG. 11, seal member 270 may comprise one or more torsion support portions 301. Torsion support portions 301 may assist a technician in further hand tightening the coupler to the terminal in that the torsion support portions provide a greater gripping surface than the a wall segment 296 alone.

Also similar to the seal member 170 of FIGS. 2-8, seal member 270 is axially moveable with respect to the coupler 160. For example, once coupler 160 is secured to terminal, seal member 270 may be slid or moved axially toward the terminal. Transformation of seal member 270 from the tightening position to deployed position (e.g., wherein the seal member contacts the terminal) is accomplished by applying pressure in a direction toward terminal.

Figure 13:
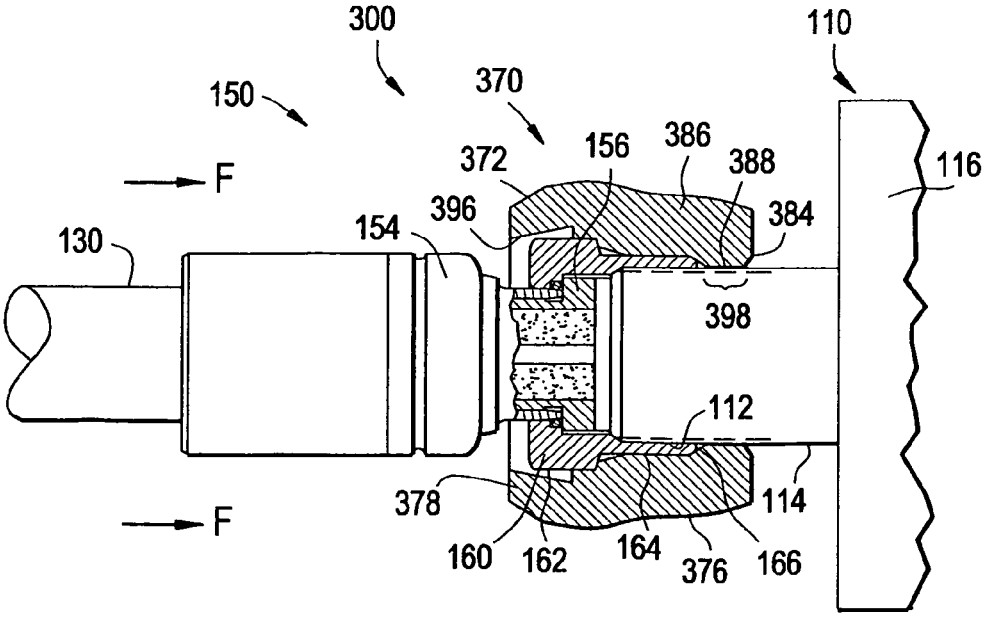
FIG. 13 is a partial cross sectional view of the coaxial cable connector/seal member assembly of FIG. 12 in a deployed/exposure position in accordance with one embodiment of the present invention.
Figure 14:
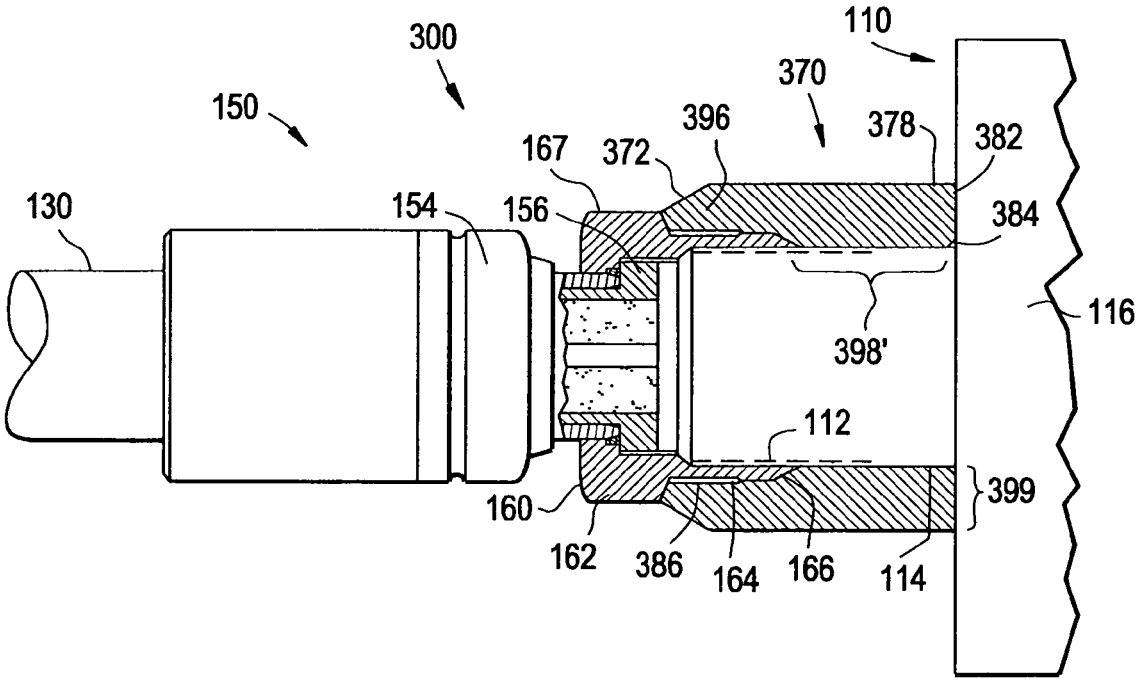
FIG. 14 is a partial cross sectional view of an alternative coaxial cable connector/seal member assembly in a deployed/exposure position in accordance with one embodiment of the present invention.

Yet another embodiment of a seal assembly 300 having a seal member contemplated herein is illustrated in FIGS. 12-14. Referring to FIG. 12, the connector of FIGS. 2 and 9 is illustrated (for attachment to the cable 130 of FIG. 10) and includes a fastening member 152, a body 154, a post 156 and a coupler 160. Coupler 160 can include threads 161, an external surface 162, a sealing surface 164, an inner bore 166 and an engagement surface 167.

The alternative embodiment of the seal member 370 comprises a first portion 371 having at least a first outer diameter 372. Transition portions 374 and 376 are located intermediate to the first portion 271 and a second portion 377 (e.g., intermediate portion 275). Second portion 377 may include at least one second outer diameter 378, a first annular face 382 and an inner chamfer area 384. Similar to the first and second outer diameters of FIGS. 2-8 (e.g., 172 and 178, respectively) the first and second diameters (e.g., 372 and 378, respectively) of FIGS. 12-14, while varying, differ in this embodiment. Still referring to FIG. 12, seal member 370 may also include variable thickness wall segment 386 along transition portions 274 and 276. A bore 388 may be located between the first annular face 382 and a second annular face 394. In addition, a counter bore 390 may be located within wall segment 392 of first portion 371.

Referring to FIGS. 12-14, connector 150 with seal member 370 installed over coupler 160 is installed to terminal 110. FIG. 12 illustrates the seal member 370 in a tightening position (e.g., wherein the seal member covers the coupler 160), whereas FIGS. 13-14 illustrate the seal member in the deployed position. FIG. 14 also illustrates the seal member in the exposure position. Conversely, a seal member can be in both the deployed and exposure positions at the same time. Particularly, referring to FIGS. 13-14, seal member 370 may be slid or moved axially toward terminal (or surface 116) in the F direction. In this embodiment, inner surface forming bore 388 contacts and conforms to the exterior surfaces of coupler 160 and eventually the terminal 110. Chamfered area 384 tracks the transition of seal member 370 from the coupler 160 onto threaded section 112 of terminal 110 as the seal member moves from a tightening position to a deployed position. Particularly, transformation of seal member 370 from the tightening position to deployed position (e.g., wherein the seal member contacts the terminal 110) is accomplished by pressure applied in a direction toward terminal 110 as indicated generally by arrows in the F direction. Referring to FIG. 14, the seal member 370 is in a deployed position because it is contacting a portion of the terminal, but is also in the exposed position because engagement surface 167 of coupler is exposed.

It is contemplated that seal member 370 can form a seal with terminal at any portion of the terminal 110. For example, referring to FIG. 13, seal member forms a seal 398 on the threaded portion of terminal 110. In such an embodiment, wall segment 396 is in contact with sealing surface 164 of coupler 160. The seal 398 between seal member 370 and terminal post may comprise any length depending on the dimensions of the seal member and/or terminal.

Referring to FIG. 14, the seal member 370 may be further slid axially about the coupler 160 and terminal 110 to form a seal 399 with a surface 160 of terminal 110. In such embodiment, annular face 382 forms seal 399 with surface 160, and the inner surface forming bore 388 forms a seal 398' with the threaded and smooth portions (e.g., 112 and 114, respectively) of terminal 110. Thus, more than one seal is formed. As illustrated, variable thickness wall segment 386 is not in contact with external surface 162 of coupler 160. Seal member 370 can be dimensioned such that its length would permit variable thickness wall segment 386 to contact external surface 162 of coupler 160, even when annular face 382 forms a seal 399 with surface 160. In addition, similar to the embodiments discussed above, seal member 370 can also be used with "long" (as illustrated in FIGS. 12-14) or "short" port terminals to form a seal between the coupler 160 and the terminal. In this regard, it should be understood that the seal members in accordance with embodiments of the present invention can be used with a number of terminals and terminal features (e.g., a terminal having an optional shoulder), and that the invention should not be limited to the examples discussed herein.

Figure 15:
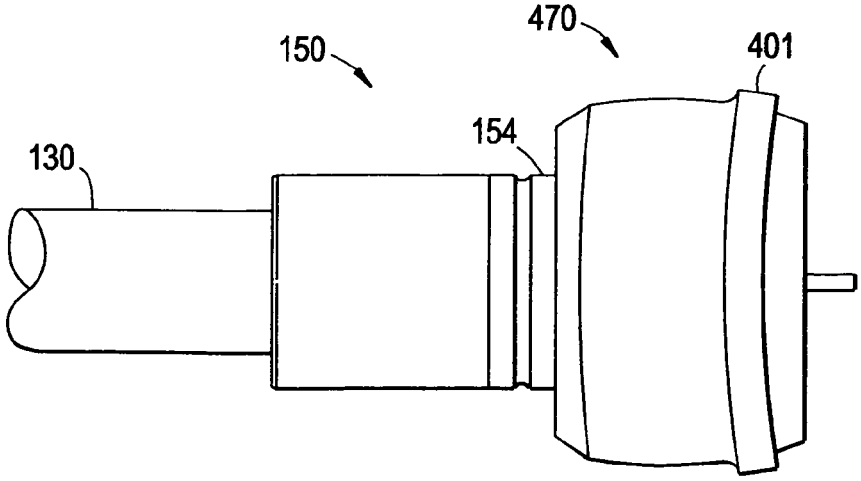
FIG. 15 is a side view of an alternative coaxial cable connector/seal member assembly in accordance with one embodiment of the present invention.
Figure 16:
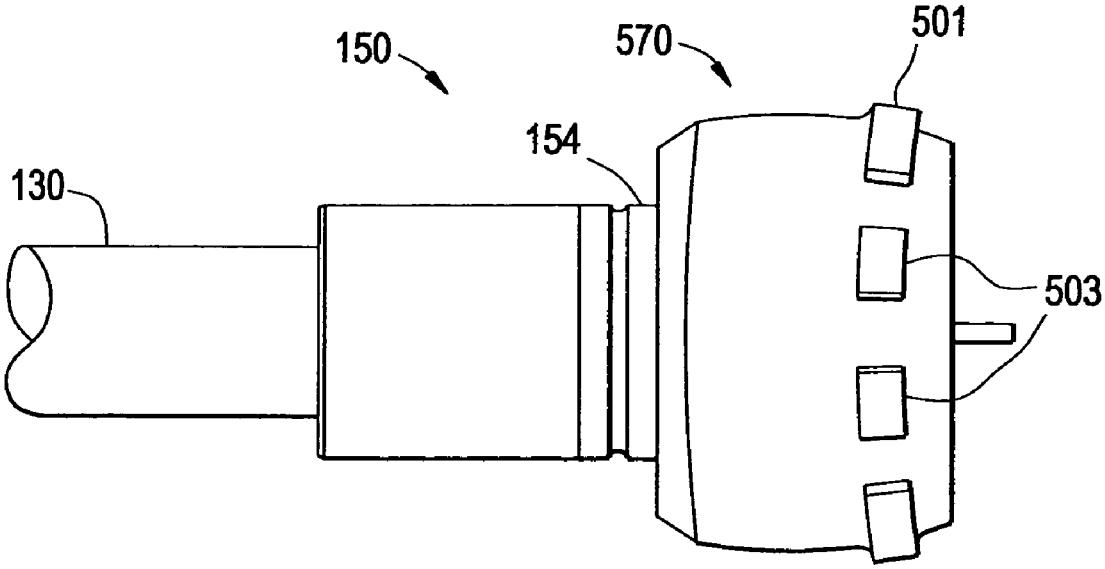
FIG. 16 is a side view of an alternative coaxial cable connector/seal member assembly in accordance with one embodiment of the present invention.
Figure 17:
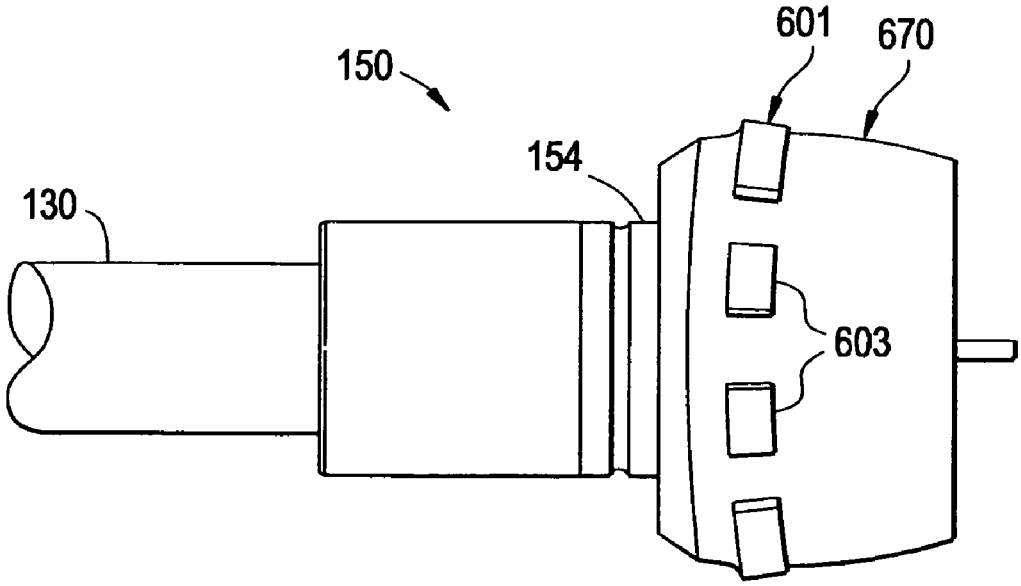
FIG. 17 is a side view of an alternative coaxial cable connector/seal member assembly in accordance with one embodiment of the present invention.
Figure 18:
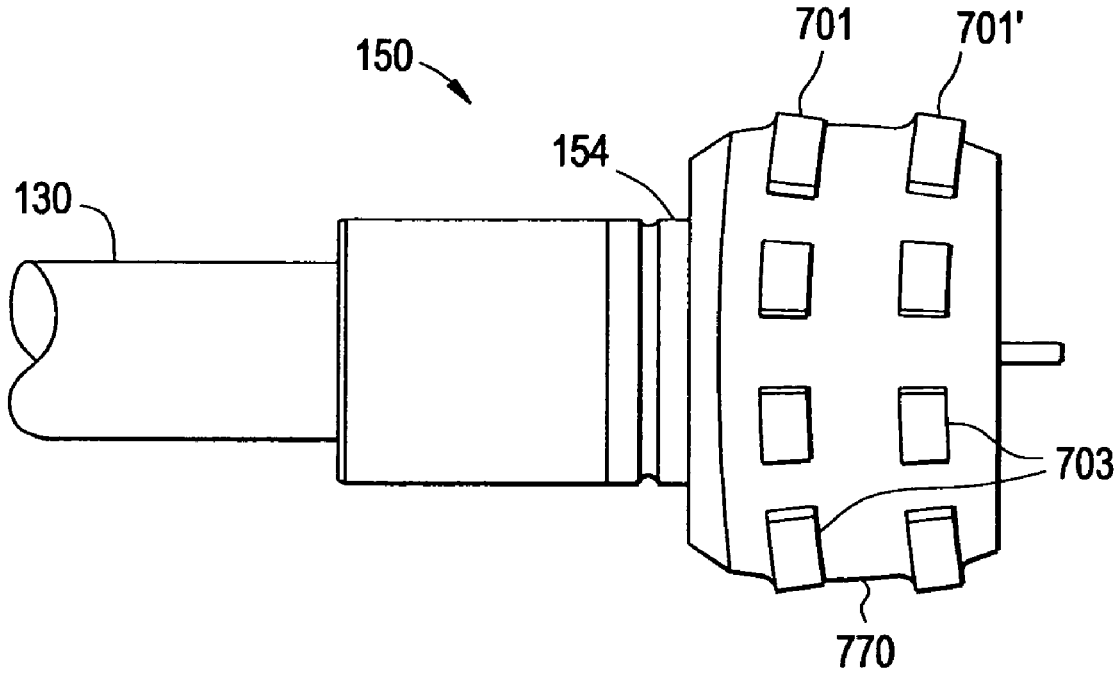
FIG. 18 is a side view of an alternative coaxial cable connector/seal member assembly in accordance with one embodiment of the present invention.

Referring to FIGS. 15-18 alternative numerous embodiments of seal assemblies with seal members (e.g., 470, 570, 670 and 770) are illustrated. In these examples, the seal assemblies resemble that of FIGS. 12-14, but differ with respect to the style and positioning of the torsion support portions (e.g., 401, 501, 601 and 701). As discussed previously herein, torsion support portions can further assist a technician in grasping seal members of the present invention in both tightening the coupler 160 and axially moving the seal members about the coupler 160. Referring to FIG. 15, seal member 470 comprises a torsion support portion 401 in the shape of an annual ring. FIG. 16 illustrates a seal member 570 having a torsion support portion 501 comprising a plurality of intermittent lugs 503. In this embodiment, the torsion support portion 501 and lugs 503 are located forward of the seal member 570. In another embodiment, such as illustrated in FIG. 17, seal member 670 having a torsion support portion 601 comprising a plurality of intermittent lugs 603 are located rearward of the seal member 670. In yet another embodiment, seal member 770 may include a plurality of torsion support portions 701 and 701' made up a plurality of intermittent lugs 703. Accordingly, as illustrated in FIGS. 2-18, any number of arrangements of seal members can be utilized within the scope of the present invention.

Referring to the various embodiments in the figures, the method of use of coaxial cable connectors with seal members will now be described. Referring to FIGS. 3-4, 10-12 and 16-18, connectors 150 with seal members 170, 270 and 470-770 installed over the couplers 160 in a coaxial relationship are illustrated. At this stage, the seal members are in a tightening position (e.g., wherein the seal member covers, and preferably substantially covers, the coupler 160). Connector 150 may be secured to or affixed to terminal 110 by aligning threads of coupler 160 with threaded section 112 of terminal 110 and rotating coupler 160 (through contact by the seal member) about terminal 110 (i.e., threadedly attached). Particularly, once the coupler 160 and terminal 110 are in mating engagement, a technician may grip the seal member (which is in contact with the coupler 160) and tighten coupler about the terminal 110 by applying force to the seal member. Because the seal member conforms to the shape of the associated coupler 160 (e.g., in a coaxial relationship), rotation of the seal member with respect to the coupler 160 is substantially prevented. To facilitate connection to the terminal 110, coupler 160 can be tightened to terminal.

Referring to FIGS. 5-7 and 12-14, once connected or affixed, the seal member maybe slid or moved longitudinally toward terminal (or surface 116) generally in the F direction, preferably without rolling, bending or flipping upon itself. Particularly, seal members described herein are configured to move or slide over the coupler when implemented while maintaining frictional contact with the coupler along at least a portion of the seal member. Moreover, as illustrated, the entire seal member is configured to slide with respect to the coupler.

Transformation of seal members from the tightening position to deployed position (e.g., wherein the seal member contacts the terminal 110) is accomplished by pressure applied in a direction toward terminal 110. It is contemplated that seal member 170 can form a seal with terminal at any portion of the terminal 110, such as the threaded portion. Referring to FIGS. 6 and 14, if desired, the seal members may be further slid longitudinally about the coupler 160 and terminal 110 to form a seal with a surface 160 of terminal 110. In such embodiment, annular face of seal member forms seal with surface 160, and the inner surface forming bore forms a seal with the threaded and smooth portions (e.g., 112 and 114, respectively) of the terminal 110.

Figure 19:
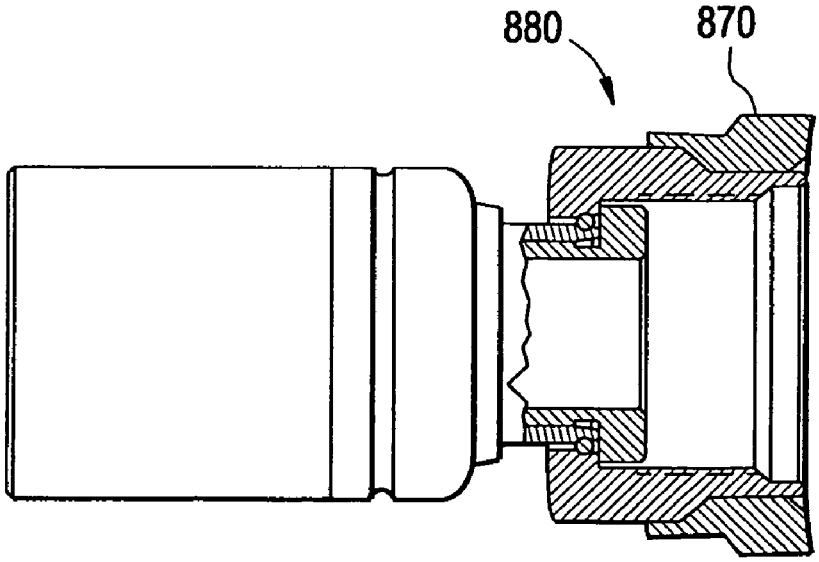
FIG. 19 is a partial cross sectional view of an assembled coaxial cable connector/seal member assembly in accordance with another embodiment of the present invention.

FIG. 19 is representative of yet other embodiments of a seal member 870, and seal member/connector assembly 880, as disclosed herein. In this embodiment, the seal member 870 does not have an overall axial length which is longer than the axial length of the coaxial connector, and in some embodiments the seal member 870 has an overall axial length which is shorter than the axial length of the coaxial connector. The assembly shown in FIG. 19 is in the tightening position, and at least a portion of the tool engagement surface of the coupler is exposed. Thus, the coupler can be hand-tightened or tool-tightened onto a terminal. The front portion of the seal member has a thicker wall thickness than the rear portion. The seal member is then slid forward along the coupler and into contact with a terminal, wherein contact is maintained with the coupler in the deployed position.

As discussed above, the ability of the seal member to be moved axially about the coupler provides benefits such as creation of a seal between the coupler 160 and the terminal 110, as well as exposure of the coupler 160 for further tightening. With respect to the latter, and referring FIGS. 4-8 and 12-14, seal members of the present invention are axially moveable from a tightening position (e.g., FIGS. 3-4, 10-12 and 16-18) for hand tightening the coupler 160 through contact with the seal member, to an exposure position (e.g., .FIGS. 6-8 and 14) via tool (FIG. 8) so that a wrench or other tightening apparatus (which can include tool 800) can be used to further secure the coupler 160 to the terminal 110. Particularly, to obtain the exposure position, the seal member is slid axially along the coupler 160 to expose at least a portion of the engagement surface 167 of the coupler 160 (e.g., at least a portion of the external surface 162) significant enough to create an engagement surface for a wrench. Once a portion of the external surface 162 (e.g., engagement surface) is exposed, a conventional wrench or other tool standard in the industry, can directly contact the coupler 160 and be used to further tighten the coupler 160. In addition, because the seal member is moveable in both directions, the connector can be easily joined with a cable without interference from seal members of the present invention. Accordingly, coaxial cable connector/seal member assemblies of the present invention can be easily installed, provide a clear view of mating threads during installation, can be used with conventional tooling, allow free turning of the connector coupler during installation, improve finger gripping for driving the coupler and provide little resistance to coupler rotation.

As disclosed herein, the seal member, in some embodiments, is moved axially without rotation (e.g. without twisting relative to the seal member itself or without rotation of at least a portion of the seal member relative to the connector and/or terminal), and in other embodiments, are moved axially while also rotating (e.g. with twisting relative to the seal member itself and/or with rotation of the seal member relative to the connector and/or terminal). In some embodiments, the inner surface of the seal member may be provided with one or more radially inwardly projecting ribs; such rib(s) may be inserted into a groove, such a groove on a threaded portion, on a terminal or other device in order to further facilitate formation of a seal thereat; in some embodiments, the ribs are threadedly disposed on the inner surface of the seal member, for example to threadedly mate with a threaded portion of a terminal, in order to further facilitate formation of a seal thereat.

It will be apparent to those skilled in the art that a number of modifications and variations can be made to the present invention without departing from the spirit and scope of the invention. Thus it is intended that the present invention cover the modifications and variations of this invention provided they come within the scope of the appended claims and their equivalents.

What is claimed is:

1. A method of connecting a coaxial connector and a terminal, the method comprising:

providing a seal member and a coaxial connector, wherein coaxial connector comprises a rotatable coupler and the seal member is in a surrounding contacting relationship with the coupler such that the seal member is coaxial with the coupler about a longitudinal axis;

affixing the connector to the terminal by rotating the seal member and the coupler; and after the connector is affixed to the terminal, sliding the seal member longitudinally toward the terminal.

2. The method according to claim 1, wherein the seal member is in contacting relationship with the coupler before the connector is affixed to the terminal and after the seal member is slid into contact with the terminal.

3. The method according to claim 1, wherein the sliding of the seal member exposes a tool engagement surface of the coupler.

4. The method according to claim 3, further comprising contacting the engagement surface with a tool.

5. The method according to claim 1, wherein a seal is formed between the connector and the terminal at a location where the seal member contacts the terminal.

6. The method according to claim 1, further comprising forming more than one seal between the connector and the terminal.

7. The method according to claim 1, wherein the seal member remains in contact with the connector after the seal member contacts the terminal.

8. A seal assembly for providing a seal with a terminal comprising:

a coaxial connector comprising a rotatable coupler; and a seal member longitudinally slideably mounted on the coupler, wherein the seal member is in a surrounding contacting coaxial relationship with the coupler and is rotatable with the coupler, wherein a front end of the seal member is substantially flush with a front end of the coupler.

* * * * *